US005364218A

United States Patent [19]

Hara

[11] Patent Number: 5,364,218

[45] Date of Patent: Nov. 15, 1994

[54] BULK MATERIAL CONVEYOR UNLOADING SYSTEM FOR SHIPS

[75] Inventor: James H. Hara, Ridgefield, Conn.

[73] Assignee: Skarhar, Inc., Greenwich, Conn.

[21] Appl. No.: 79,076

[22] Filed: Jun. 16, 1993

[51] Int. Cl.[5] ..... B63B 27/22

[52] U.S. Cl. ..... 414/142.4; 198/544; 198/547; 414/142.3

[58] Field of Search ..... 414/142.3, 142.4, 142.1, 414/142.2; 198/544, 546, 547, 550.13

[56] References Cited

U.S. PATENT DOCUMENTS

| | | | |
|---|---|---|---|
| 974,104 | 10/1910 | Doxford | 198/544 X |
| 3,191,998 | 6/1965 | Howlett | 414/142.3 X |
| 3,572,276 | 3/1971 | Skaarup | 414/142.2 X |
| 4,072,238 | 2/1978 | Vaughan | 414/142.3 X |

*Primary Examiner*—Michael S. Huppert
*Assistant Examiner*—Janice L. Krizek
*Attorney, Agent, or Firm*—John H. Crozier

[57] ABSTRACT

In a preferred embodiment, a system for unloading bulk material from a ship, which system includes: an elevating conveyor having a first, inclined section to raise bulk material from a lower space in the hull of the ship to a point above the deck thereof at the distal end of the elevating conveyor; the elevating conveyor having at the proximal end thereof a second section over which is disposed a single row of discharge gates generally parallel to the centerline of the ship and connected to the bottoms of a first plurality of hoppers which contain a first portion of bulk material, so as to selectively discharge the first portion onto the second section; cross conveyors to discharge a second portion of bulk material onto the cross conveyors; parallel conveyors generally parallel to the centerline to discharge the second portion onto the cross conveyors; each of the parallel conveyors being disposed underneath a row of discharge gates connected to bottoms of a second plurality of hoppers containing the second portion, so as to selectively discharge the second portion onto the parallel conveyors; and the cross conveyors being disposed at a location along the centerline between the first plurality of hoppers and the second plurality of hoppers.

3 Claims, 4 Drawing Sheets

BULK MATERIAL CONVEYOR UNLOADING SYSTEM FOR SHIPS

BACKGROUND OF THE INVENTION

1. Field of the Invention

The present invention relates to bulk material unloading systems for ships generally and, more particularly, but not by way of limitation, to a novel conveyor system for unloading bulk cargo from ships, which conveyor system has significant advantages over conventional conveyor systems for unloading bulk material from ships.

2. Background Art

Bulk cargo ships are widely used for conveying a large range of bulk materials, such as iron ore, coal, grain, woodpulp, and gypsum, for example. Until recent developments in unloading systems, such materials were unloaded using buckets suspended from cranes located on the ship or on shore adjacent the ship.

In recent years, self unloading systems have been developed which use conveyors installed on the ships under hopper holds which contain the bulk material. In a typical such system, a plurality of holds are arranged fore and aft, each hold having a plurality of hoppers formed at the bottom of each, the hoppers having discharge gates at the apexes thereof for the controlled discharge therethrough of the bulk material. The discharge gates are arranged in two fore and aft lines, the lines being disposed generally midway between the centerline of the ship and the sides of the hull. Two parallel conveyors are provided under the lines of discharge gates, extending from the aft discharge gate in the aftermost hold to the forward gate in the forwardmost hold. At the latter point, the parallel conveyors discharge the bulk material onto two cross conveyors which discharge onto the lower end of a straight, inclined conveyor which, in turn, raises the bulk material to the deck of the ship. On the deck of the ship, the bulk material is discharged onto a boom-mounted conveyor to tranport the bulk material over the side of the ship to another vessel or to a point on land.

There are a number of disadvantages to the conventional system described above. The narrowing of the forwardmost hold adds complexity in the converging of the parallel conveyors to the cross conveyors. This complexity increases the amount of spillage of the bulk material. The straight inclined conveyor decreases the volume of the forwardmost hold that would be otherwise available for the bulk material. The latter problem results in less stability for the ship, due to the concomitant raising of the center of gravity, which must be compensated for by adding ballast.

Accordingly, it is a principal object of the present invention to provide an improved bulk material conveyor unloading system for a ship, which system maximizes the quantity of bulk material that can be carried by the ship.

It is an additional object of the invention to provide such an improved unloading system which is simpler and more economical to install than conventional unloading systems.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a system for unloading bulk material from a ship, comprising: an elevating conveyor disposed in said ship, said elevating conveyor having a first, inclined section to raise said bulk material from a lower space in the hull of said ship to a point above the deck of said ship at the distal end of said elevating conveyor; said elevating conveyor having at the proximal end thereof a second section over which is disposed a single row of discharge gates generally parallel to the centerline of said ship and connected to the bottoms of a first plurality of hoppers which contain a first portion of said bulk material, so as to selectively discharge said first portion of some of said bulk material onto said second section of said elevating conveyor; cross conveyors disposed in said ship to discharge a second portion of some of said bulk material onto said cross conveyors; parallel conveyors disposed in said ship generally parallel to said centerline of said ship to discharge said second portion of some of said bulk material onto said cross conveyors; each of said parallel conveyors being disposed underneath a row of discharge gates connected to bottoms of a second plurality of hoppers containing said second portion of some of said bulk material, so as to selectively discharge said second portion of said bulk material onto said parallel conveyors; and said cross conveyors being disposed at a location along said centerline of said ship between said first plurality of hoppers and said second plurality of hoppers.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
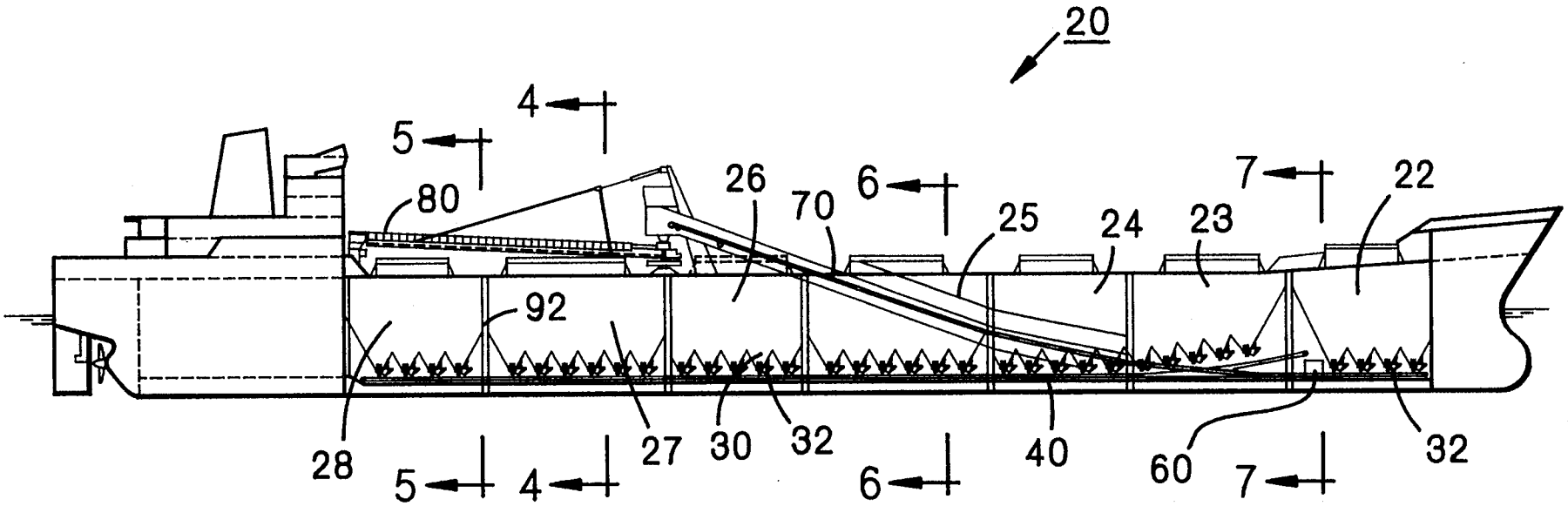
FIG. 1 is a side elevational view, in cross-section, of a bulk cargo ship in which is incorporated the system of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
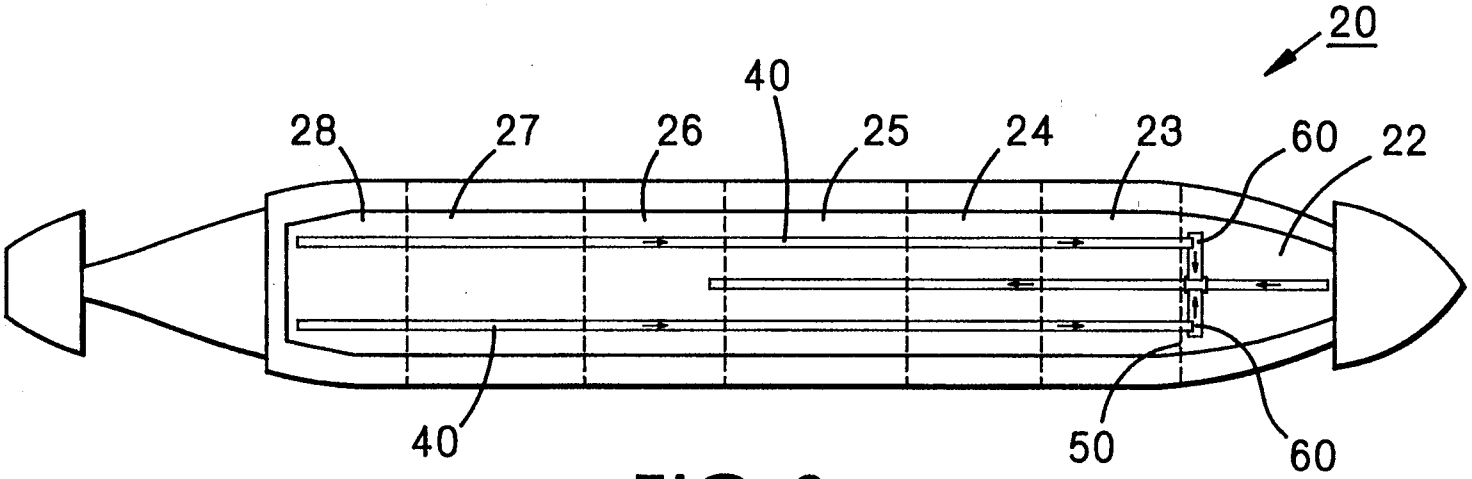
FIG. 2 is a top plan, cut-away view, of the ship of FIG. 1.
Figure 4:
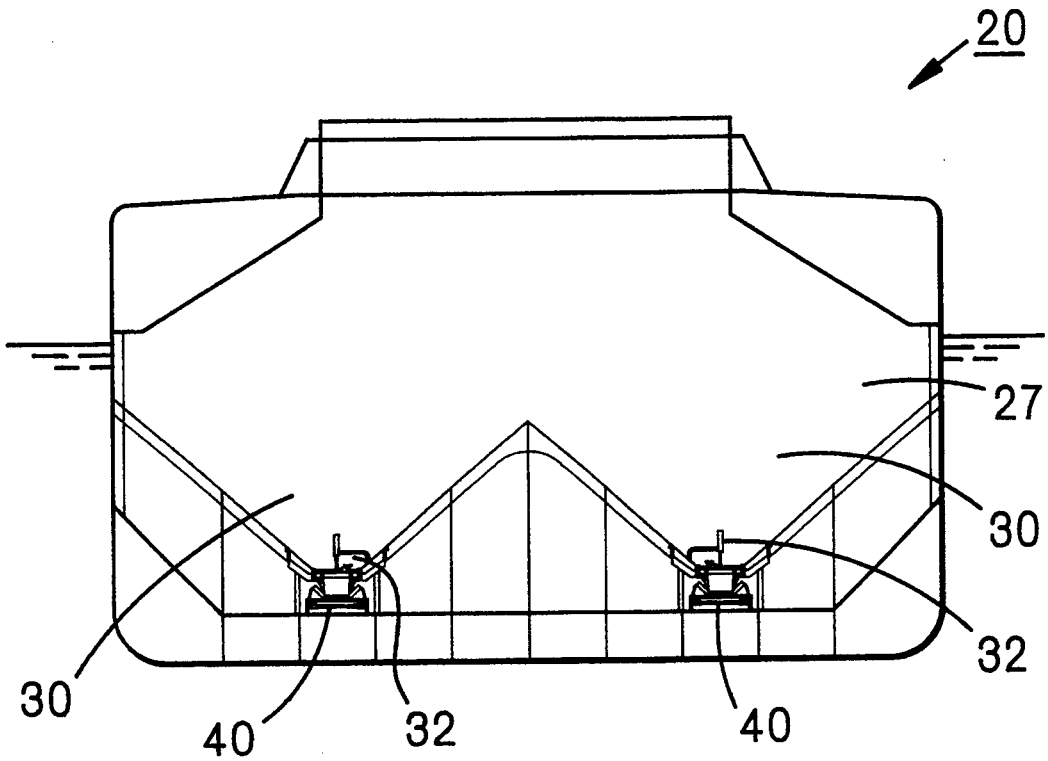
FIG. 4 is an end elevational view, in cross-section, taken along line "4—4" of FIG. 1.

FIGS. 1–7 illustrate a bulk cargo ship, generally indicated by the reference numeral 20, which has installed therein the system of the present invention; however, primary reference should initially be made together to FIGS. 1 and 2.

Ship 20 includes seven bulk material carrying holds 22–28 arranged in line from the bow of the ship where hold 22 is disposed to a portion of the ship near the stern thereof where hold 28 is disposed. Ship 20 may, if desired, have fewer or greater than seven holds and the present invention is not limited thereto.

Formed as the bottoms of holds 22–28 are a plurality of hoppers, as at 30, having attached to the apexes thereof an equal plurality of hydraulically operated discharge gates, as at 32. Discharge gates 32 attached to holds 23–28 are arranged in two parallel fore and aft rows (FIGS. 2, 4, and 6), with the rows being disposed on opposite sides of the centerline of ship 20 approximately midway between the centerline and the hull of the ship. Disposed underneath each row of discharge gates 32 is one of two parallel, trough-type conveyors 40 (FIG. 2, 4, and 6), such that the opening of one or more discharge gates 32 will cause bulk material (not shown) to fall upon the parallel conveyors.

Thus far, the elements described are conventionally employed on known bulk material conveyor unloading systems. As noted previously, the parallel conveyors of conventional systems would conventionally extend to the forward portion of hold 22 where cross conveyors would transport bulk material (not shown) to a straight inclined conveyor which would raise the bulk material above the deck of ship 20. However, such an arrangement has certain disadvantages, as also noted previously.

Figure 7:
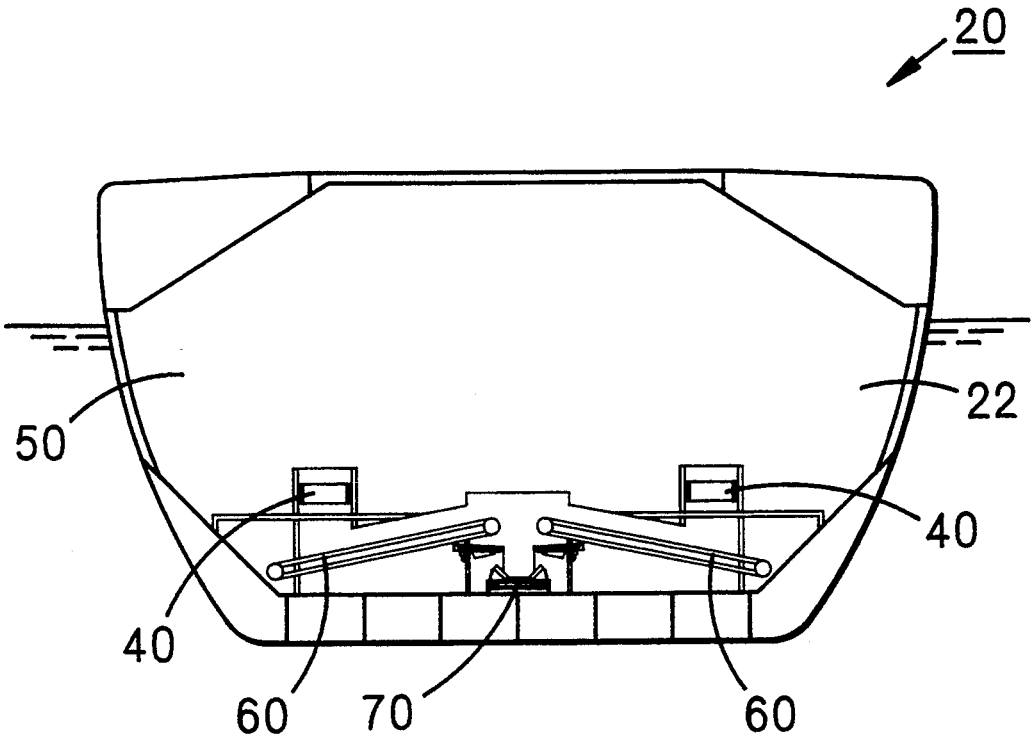
FIG. 7 is an end elevational view, in cross-section, taken along line "7—7" of FIG. 1.

In accordance with the present invention, parallel conveyors 40 terminate just forward of the aft transverse bulkhead 50 of hold 22 (FIGS. 2 and 7). As parallel conveyors 40 approach this point, they are inclined slightly upward (FIG. 1) so that they may discharge bulk material onto two, trough-type cross conveyors 60 (FIGS. 2 and 7), orthogonal to the centerline of ship 20, which elevate the bulk material to the centerline and discharge it onto an elevating trough-type conveyor 70 which raises the bulk material above the deck of the ship. There, the bulk material is discharged from the distal end of elevating conveyor 70 onto a conventional boom-mounted conveyor 80 for removal from ship 20.

Referring again primarily to FIGS. 1 and 2, it will be understood that hold 22 has a single row of discharge gates aligned on the centerline of ship 20 and disposed over a proximal, horizontal portion of elevating conveyor 70 for the discharge thereon of bulk material.

Figure 3:
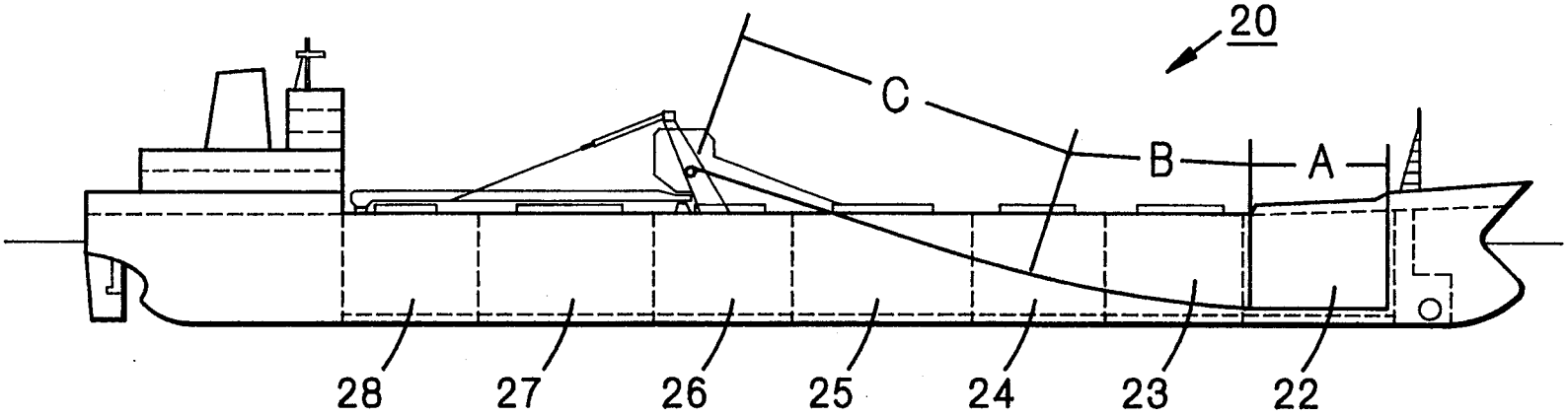
FIG. 3 is a fragmentary side elevational view, in cross-section, of the ship of FIG. 1.

Referring now to FIG. 3, it can be seen that elevating conveyor 70 includes the above-described horizontal portion, indicated by the reference letter "A" on FIG. 3. The next portion of elevating conveyor 70, indicated by the reference letter "B" on FIG. 3, is curved upwardly from the end of horizontal portion "A". Finally, a straight portion of elevating conveyor 70, indicated by the reference letter "C" on FIG. 3, extends upwardly from portion "B" to above the deck of ship 20.

The above arrangement minimizes the volume of hold 22 required for the transfer operations and the additional volume gained over conventional unloading systems may be used for bulk cargo. The location of cross conveyors 60 may be further aft, if desired; however, the location is preferably immediately forward or aft of a transverse bulkhead to eliminate problems with high bottom hoppers that would result if the cross conveyors were located away from a transverse bulkhead. The discharge of cross conveyors 60 onto elevating conveyor 70 at horizontal section "A" thereof tends to minimize spills that otherwise would occur when discharging onto an inclined conveyor. Spillage is also minimized by the provision of section "B" of elevating conveyor 70 as a transition between sections "A" and "C" thereof. Installation cost savings are realized by eliminating the extension of parallel conveyors 40 into hold 22.

Figure 6:
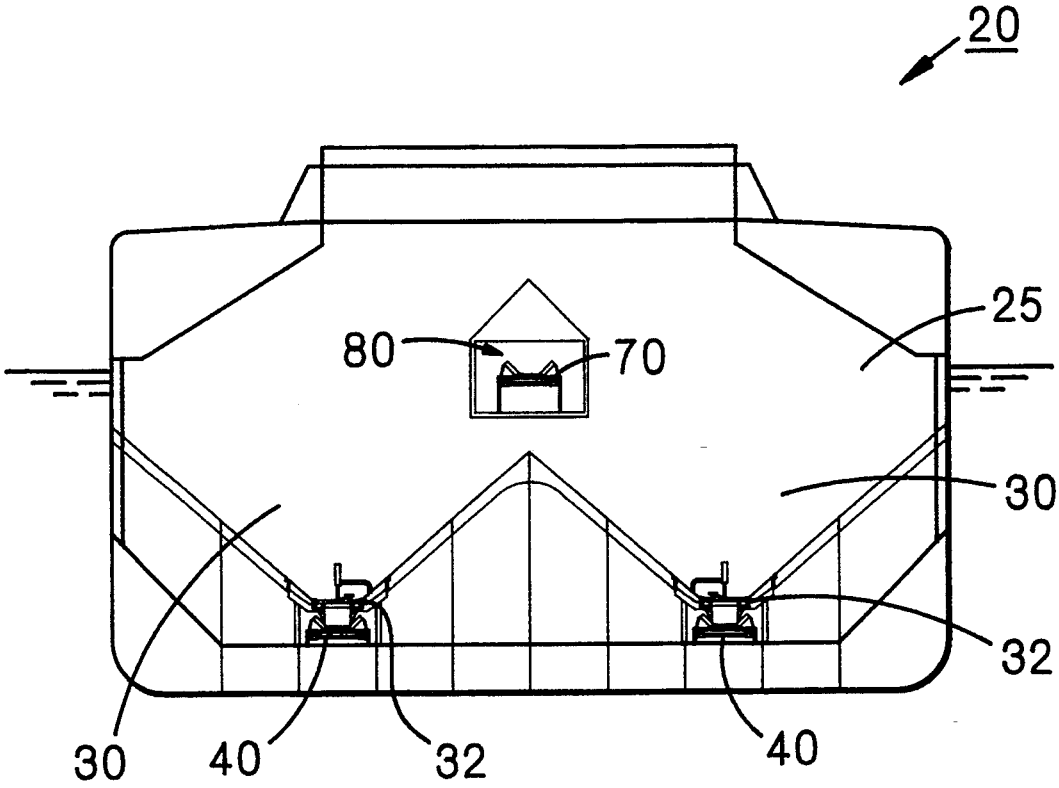
FIG. 6 is an end elevational view, in cross-section, taken along line "6—6" of FIG. 1.

Referring to FIG. 6, a channel 80 is provided for the installation of elevation conveyor 70.

Figure 5:
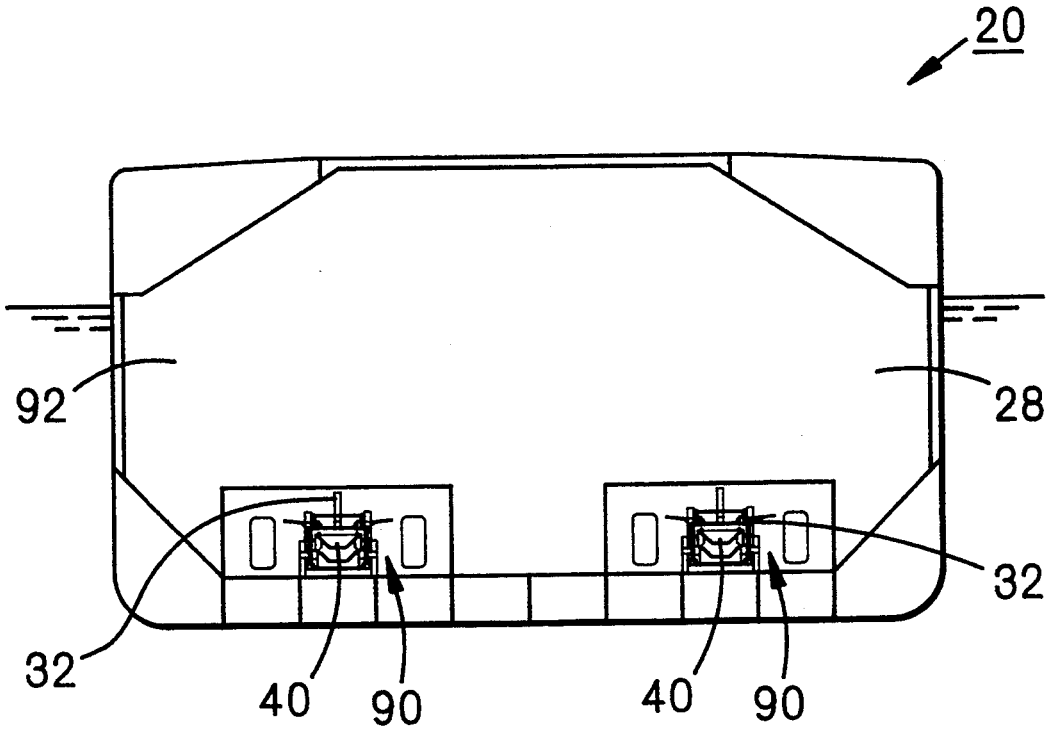
FIG. 5 is an end elevational view, in cross-section, taken along line "5—5" of FIG. 1.

Referring to FIG. 5, openings 90 are defined in forward transverse bulkhead 92 of hold 28 (also FIG. 1) for the installation therethrough of parallel conveyors 40.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A system for unloading bulk material from a ship, comprising:

(a) a continuous elevating conveyor disposed in said ship, said elevating conveyor having a first, inclined section to raise said bulk material from a lower space in the hull of said ship to a point above the deck of said ship at the distal end of said elevating conveyor;

(b) said elevating conveyor having at the proximal end thereof a second, generally horizontal, section over which is disposed a single row of discharge gates generally parallel to the centerline of said ship and connected to the bottoms of a first plurality of hoppers which contain a first portion of said bulk material, so as to selectively discharge said first portion of said bulk material onto said second section of said elevating conveyor;

(c) cross conveyors disposed in said ship to discharge a second portion of said bulk material onto said second section of said elevating conveyor;

(d) parallel conveyors disposed in said ship generally parallel to said centerline of said ship to discharge said second portion of said bulk material onto said cross conveyors;

(e) each of said parallel conveyors being disposed underneath a row of discharge gates connected to bottoms of a second plurality of hoppers containing said second portion of said bulk material, so as to selectively discharge said second portion of said bulk material onto said parallel conveyors; and (e) said cross conveyors being disposed at a location along said centerline of said ship between said first plurality of hoppers and said second plurality of hoppers.

2. A system for unloading bulk material from a ship, as defined in claim 1, wherein said first and second pluralities of hoppers are disposed in a plurality of holds aligned fore and aft in said ship and said cross conveyors are located adjacent the aft transverse bulkhead of the forwardmost hold.

3. A system for unloading bulk material from a ship, as defined in claim 1, wherein said elevating conveyor includes a third, curved transition section between said first and second sections thereof.

* * * * *